US011346120B2

(12) United States Patent
Blary

(10) Patent No.: US 11,346,120 B2
(45) Date of Patent: May 31, 2022

(54) ROLLING-UNROLLING DEVICE FOR A PROTECTIVE COVER

(71) Applicant: Groupe Waterair S.A.S., Seppois le Bas (FR)

(72) Inventor: Christophe Blary, Altkirch (FR)

(73) Assignee: Groupe Waterair S.A.S.

( * ) Notice: Subject to any disclaimer, the term of this patent is extended or adjusted under 35 U.S.C. 154(b) by 186 days.

(21) Appl. No.: 16/854,179

(22) Filed: Apr. 21, 2020

(65) Prior Publication Data

US 2020/0340262 A1 Oct. 29, 2020

(30) Foreign Application Priority Data

Apr. 26, 2019 (FR) ..... 1904494

(51) Int. Cl.
*E04H 4/10* (2006.01)
*B65H 75/44* (2006.01)

(52) U.S. Cl.
CPC ..... *E04H 4/101* (2013.01); *B65H 75/4442* (2013.01); *B65H 75/4497* (2013.01)

(58) Field of Classification Search
None
See application file for complete search history.

(56) References Cited

U.S. PATENT DOCUMENTS 3,050,743 A * 8/1962 Lamb ..... E04H 4/101 4/502
3,747,132 A * 7/1973 Foster ..... E04H 4/101 4/502
3,982,286 A * 9/1976 Foster ..... E04H 4/101 4/502
4,195,370 A * 4/1980 Budd ..... E04H 4/101 4/502
4,351,072 A * 9/1982 Smith ..... E04H 4/101 4/502

(Continued)

FOREIGN PATENT DOCUMENTS

FR 2893651 5/2007
FR 2908402 5/2008

(Continued)

OTHER PUBLICATIONS

English Translation of FR 2893651, "Salvage cover winder", May 25, 2007 (Year: 2007).*

*Primary Examiner* — William A. Rivera
(74) *Attorney, Agent, or Firm* — Forge IP, PLLC

(57) ABSTRACT

A rolling-unrolling device for a protective cover for covering a surface to be protected is presented. The device is self-propelling and includes a braking system for blocking the rotation of at least one drive wheel of the carriages and causing the cover to be automatically tensioned during the rolling up thereof on the roller tube. This braking system includes a movable pawl integral with each of the carriages, and a ratchet wheel integral with the drive wheel of each of the carriages, such that, in the direction of rotation corresponding to the unrolling of the cover, the pawl is not engaged with the ratchet wheel and the braking system is in the passive position, and in the opposite direction of rotation corresponding to the rolling up of the cover, the pawl is engaged with the ratchet wheel and the braking system is in the active position.

16 Claims, 5 Drawing Sheets

(56) References Cited

U.S. PATENT DOCUMENTS

| | | | | | |
|---|---|---|---|---|---|
| 4,407,027 | A * | 10/1983 | Colon, Jr. | E04H 4/101 | 188/382 |
| 4,815,152 | A * | 3/1989 | MacDonald | E04H 4/101 | 4/498 |
| 4,858,253 | A * | 8/1989 | Lamb | E04H 4/101 | 4/502 |
| 5,524,302 | A * | 6/1996 | Ragsdale | E04H 4/101 | 4/502 |
| 6,871,362 | B1 * | 3/2005 | Zell | E04H 4/101 | 4/502 |
| 2008/0016611 | A1 * | 1/2008 | Khalaf | E04H 4/086 | 4/498 |
| 2016/0047134 | A1 * | 2/2016 | Coenraets | E04H 4/101 | 160/243 |
| 2019/0010757 | A1 * | 1/2019 | Coenraets | B60J 7/085 | |

FOREIGN PATENT DOCUMENTS

| | | |
|---|---|---|
| FR | 3084095 | 1/2020 |
| WO | WO2010091252 | 8/2010 |
| WO | WO2014060708 | 4/2014 |

* cited by examiner

ROLLING-UNROLLING DEVICE FOR A PROTECTIVE COVER

TECHNICAL FIELD

The present invention relates to a rolling-unrolling device for a protective cover for covering a surface to be protected, said device comprising a roller tube supported at the ends thereof by two carriages provided with wheels, at least one whereof is a drive wheel, and means for driving the rotation of said roller tube and of said drive wheel designed to displace said rolling-unrolling device in translation relative to said surface to be protected in one direction in order to unroll said cover and in the opposite direction in order to roll up said cover, said device further comprising a braking system designed to slow or prevent the rotation of said at least one drive wheel of the carriages and cause said cover to be tensioned at least during the rolling up of said cover on said roller tube.

PRIOR ART

A protective cover is commonly used to protect any kind of surface, for example an agricultural surface, a sports ground, a pool or a similar surface, and devices for rolling and/or unrolling such covers are just as commonly used.

The invention more particularly relates to motor-driven rolling and unrolling devices which move over the surface to be protected in order to deploy and remove the protective cover without it sliding on said surface and without rails on the ground (WO 2010/091252 A1), such as those described in the publications FR 2 893 651 A1 and FR 2 908 402 A1. In such a case, one of the ends of the protective cover is fastened to the roller tube, whereas the opposite end is fastened to the ground, by anchoring means allowing said cover to be tensioned during the rolling up thereof and causing the device to reverse by traction. The devices as described further comprise means for synchronising the advance speed of the device with the unrolling speed of the cover, and engaging/disengaging means of said drive means allowing the one or more drive wheels to be disengaged in order to allow the device to be towed by the cover during the rolling up thereof. The synchronising means are in particular formed by a slipping system at the drive wheels, and the engaging/disengaging means are in particular formed by a free wheel arranged between the drive means and the roller tube on the one hand, and between the drive means and the drive wheels on the other hand.

However, these rolling-unrolling devices are not entirely satisfactory. More specifically, the rolling up of the cover has been seen to generate a non-symmetrical displacement between the right carriage and the left carriage, in particular linked to the unbalance of the protective cover and the inertia of the carriages. This drawback is amplified when the protective cover comprises a plurality of crossbars which are used to stiffen the protective cover in the deployed position thereof to prevent it from sagging, especially in the case of pools where the surface to be protected is hollow as a result of the presence of the pool of water. These crossbars increase the weight of the cover by an equal degree and allow it to be held in position in the event of strong winds. In order to partially overcome the problem caused by the crossbars, the device described in the publication FR 2 893 651 A1 comprises means for tensioning the cover and for aligning the crossbars when rolling and unrolling. These means are in particular formed by a cross roller that is free to move in rotation, articulated on the back face of the device, and means for anchoring the fixed end of the cover. Again, these means can be insufficient since they do not prevent the cover from rolling up on itself around the roller tube in a non-homogeneous manner, causing a non-synchronous displacement of the carriages, folds in the cover, difficulties in unrolling it along the axis of the surface to be protected, or, depending on the type of protective cover, said cross roller becoming blocked against one of the crossbars of the cover.

The rolling-unrolling device described in the publication WO 2014/060708 A1 comprises a mechanical braking system in the form of a brake shoe that acts directly on the tire tread of at least one of the drive wheels when rolling up the cover in order to compensate for the disequilibrium phenomena that are created by the unbalance resulting from a non-rectilinear rolling up of the cover. However, this braking system has the major drawback of acting directly on the tire. The efficacy thereof thus varies as a function of the climatic conditions and state of the surface on which the tire travels. Moreover, this braking system causes damage and premature wear to the tire. This is why it comprises a means for adjusting the displacement of the brake shoe for compensating the tire wear. This solution is thus unsatisfactory.

DESCRIPTION OF THE INVENTION

The present invention aims to overcome these drawbacks by proposing a rolling-unrolling device provided with a mechanical braking system, that is simple in design, reliable and maintenance-free, guaranteeing a synchronous displacement of the right and left carriages, in addition to guaranteeing that the protective cover is rolled up parallel to the axis of the roller tube, for all types of cover, with or without crossbars, and for all kinds of running surface on which the carriages of said device move, the efficacy of this braking system being constant, regardless of the climatic conditions.

For this purpose, the invention relates to a rolling-unrolling device of the type specified in the preamble, characterized in that said at least one drive wheel comprises a core supporting a rim comprising a tire, in that said core is designed to slip on said rim under the action of a slippage force originating from their difference in rotational speed, and in that said braking system is designed to act on the core of said at least one drive wheel.

Thanks to this original design, the braking system is physically independent of the tire, of the tread thereof, of the surface on which the carriages travel, and of the climatic conditions, which guarantees a constant and reproducible braking efficacy, and significantly simplifies the mechanism, which does not require a play compensation device.

In one preferred embodiment of the invention, said braking system is a mechanical system arranged so as to take at least two unstable positions, i.e. a passive position in one direction of rotation of said drive means corresponding to the unrolling of said cover, and an active position in the opposite direction of rotation of said drive means corresponding to the rolling up of said cover, the change from the passive position to the active position and vice-versa of said braking system being automatically generated by the reversal of the direction of rotation of said drive means.

The braking system can advantageously comprise a movable pawl integral with each of said carriages, and a ratchet wheel integral with said at least one drive wheel of each of said carriages, such that, in the direction of rotation corresponding to the unrolling of said cover, the pawl is not engaged with the ratchet wheel and the braking system is in the passive position, and in the opposite direction of rotation corresponding to the rolling up of said cover, the pawl is engaged with the ratchet wheel and the braking system is in the active position.

Preferentially, said ratchet wheel is integral with the core of said at least one drive wheel.

In a first embodiment, the pawl can comprise a rigid lever, mounted on each of said carriages, free to rotate about an articulation shaft situated above and perpendicular to said at least one of the wheels of the carriage, such that in the neutral position, said pawl extends under gravity radially inside said corresponding ratchet wheel, along a vertical axis passing through the rotational axis of said wheel.

In such a case, the braking system advantageously comprises a fixed stop on each of said carriages in the near vicinity of said pawl in order to block it in the active position when engaged with said ratchet wheel.

In a second embodiment, the pawl can comprise a flexible lever, mounted on each of said carriages, at a fixed point that is offset relative to the vertical axis passing through the rotational axis of said at least one of the wheels of the carriage, such that, in the neutral position, said pawl extends more or less inside said corresponding ratchet wheel.

In such a case, the braking system is advantageously adjustable and the pawl can be mounted on a support that can be angularly adjusted relative to said ratchet wheel, such that said pawl is more or less inclined relative to the circle formed by said ratchet wheel so as to adjust the brake force.

The support for said pawl can be mounted on the carriage by angular adjustment means, which can comprise a ball screw housed through positioning holes defining a plurality of positions for adjusting the inclination of said pawl.

In the preferred embodiment, said ratchet wheel can comprise a plurality of projecting spurs on at least one of the sides of said at least one drive wheel and arranged in a circle concentric with the rotational axis of said drive wheel.

The coefficient of friction between the core and the rim of said at least one drive wheel is preferentially less than the coefficient of friction between the tire and the ground, the difference between the two coefficients capable of lying in the range 0.05 to 0.5.

The material of the tire can be derived from the family of EPDM-type rubbers having a low Shore hardness that lies in the range 40 to 70 ShA and/or a high ultimate tensile strength that lies in the range 30 to 50 MPa.

Depending on the alternative embodiments, the plane passing through the wheels of a same carriage can be parallel to the XZ-plane of an orthonormal frame of reference or can form an angle of less than 10° with the XZ-plane of said orthonormal frame of reference, the rotational axes of said wheels remaining parallel.

BRIEF DESCRIPTION OF THE FIGURES

The present invention and the advantages thereof will appear more clearly in the following description of a plurality of embodiments given for purposes of illustration only and not intended to limit the scope of the invention, with reference to the accompanying drawings, wherein.

DETAILED DESCRIPTION OF THE INVENTION

Figure 1:
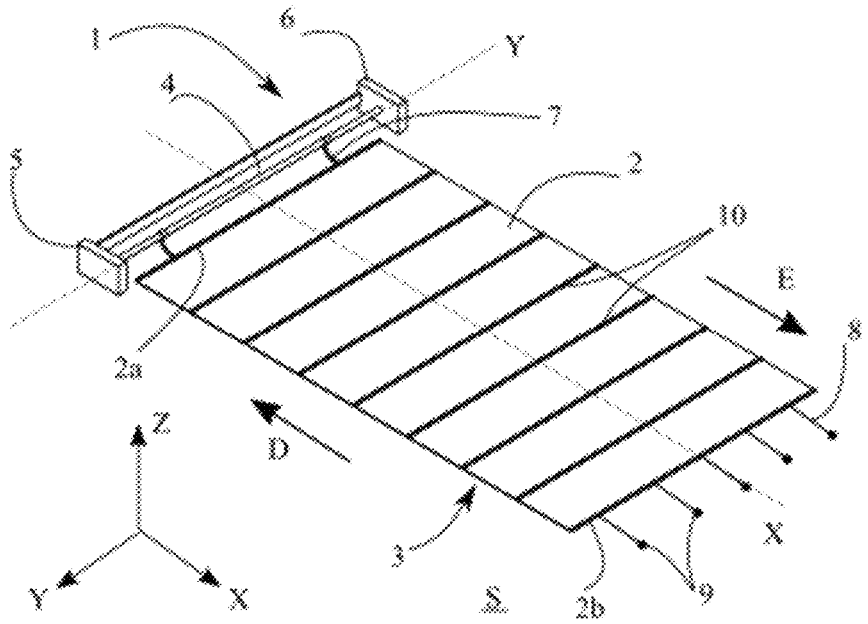
FIG. 1 is a diagrammatic view of a rolling-unrolling device for a protective cover according to the invention for protecting a surface.
Figure 2:
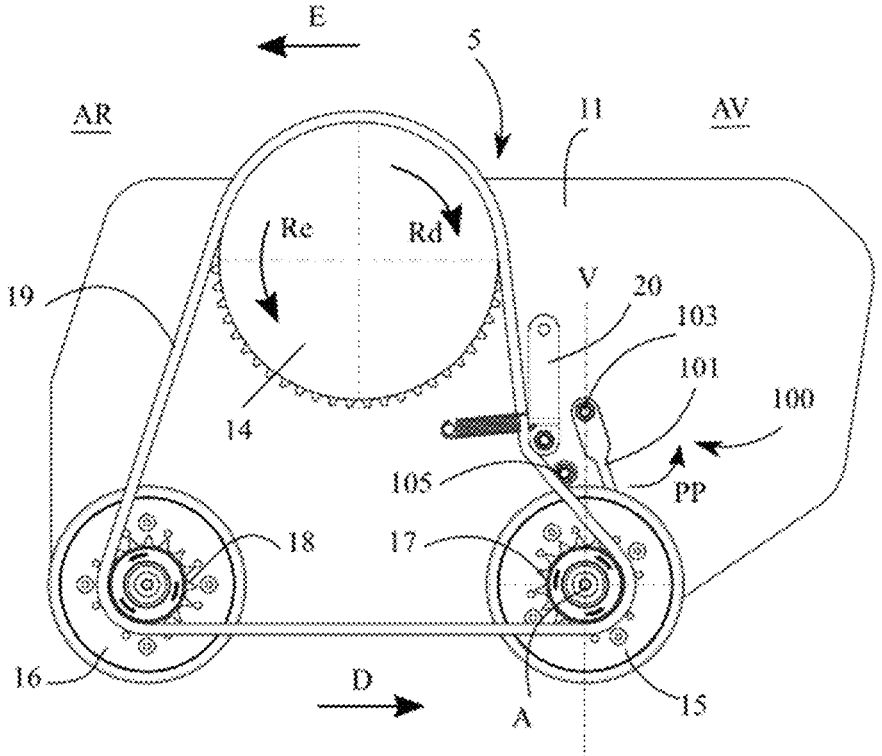
FIG. 2 is a plan view of one face of a carriage of the device in FIG. 1, according to a first alternative embodiment of the invention, one of the side flanges having been removed to show the drive and rolling means.

In the example embodiments shown, identical elements or parts bear the same reference numerals. Moreover, the terms having a relative meaning, such as vertical, horizontal, right, left, front, back, above, below, etc. must be interpreted under normal conditions of use of the invention, and as shown in the figures. The X- and Y-axes are defined by an orthonormal frame of reference shown in FIG. 1.

With reference to FIG. 1, the rolling-unrolling device 1 for a protective cover 2 according to the invention is a motor-driven device taking on the form of a portal frame which moves in translation along the X-axis over a surface 3 to be protected to deploy and remove the cover 2 without causing it to slide on said surface 3 and without rails on the ground S. It can be controlled by any suitable control member, such as a wired controller, a wireless controller, or a remote control, etc. The device 1 comprises a roller tube 4 extending along the Y-axis perpendicular to the X-axis, supported at the ends thereof by two carriages 5, 6, a left carriage 5 and a right carriage 6 with reference to FIG. 1, provided with rolling means in contact with the ground S, and means (not shown) for driving the rotation of the roller tube 4 and rolling means of the carriages 5, 6. Thus, the device 1 moves in translation along the X-axis in one direction, shown by the arrow D, to unroll the cover 2 from the roller tube 4 and deploy it over the surface 3, and in an opposite direction E to roll up the cover 2 on the roller tube 4 and remove it from the surface 3. The carriages 5, 6 have two functions: a "driving" function when displacing the device 1 to unroll the cover 2 and a "following" function when being towed by the device 1 to roll up the cover 2. The alternating displacements of the device 1 are made possible by the assembly of the cover 2 between a fixed point on the ground S and a movable point linked to said device 1. More particularly, one of the ends 2*a* of the cover 2 is fastened to the roller tube 4 by any suitable fastening means such as first straps 7 allowing it to roll up on itself around said tube, and the opposite end 2*b*, also referred to as the apparent end, is fastened to the ground S or to any fixed support, by any suitable anchoring means such as second straps 8 linked to eye bolts 9 anchored in the ground S or in said fixed support. The fixed end 2*b* allows the cover 2 to be tensioned during the rolling up thereof and causes the device 1 to be displaced in the direction E by being towed by the cover itself Δny other compatible fastening or anchoring means is possible. In the example shown in FIG. 1, the cover 2 further comprises a plurality of crossbars 10 for stiffening it when unrolled over the surface 3 to be protected and for ensuring the safety of individuals, in particular if the surface 3 is a pool. It could also not comprise crossbars in the case of other surfaces 3 to be protected.

Figure 7:
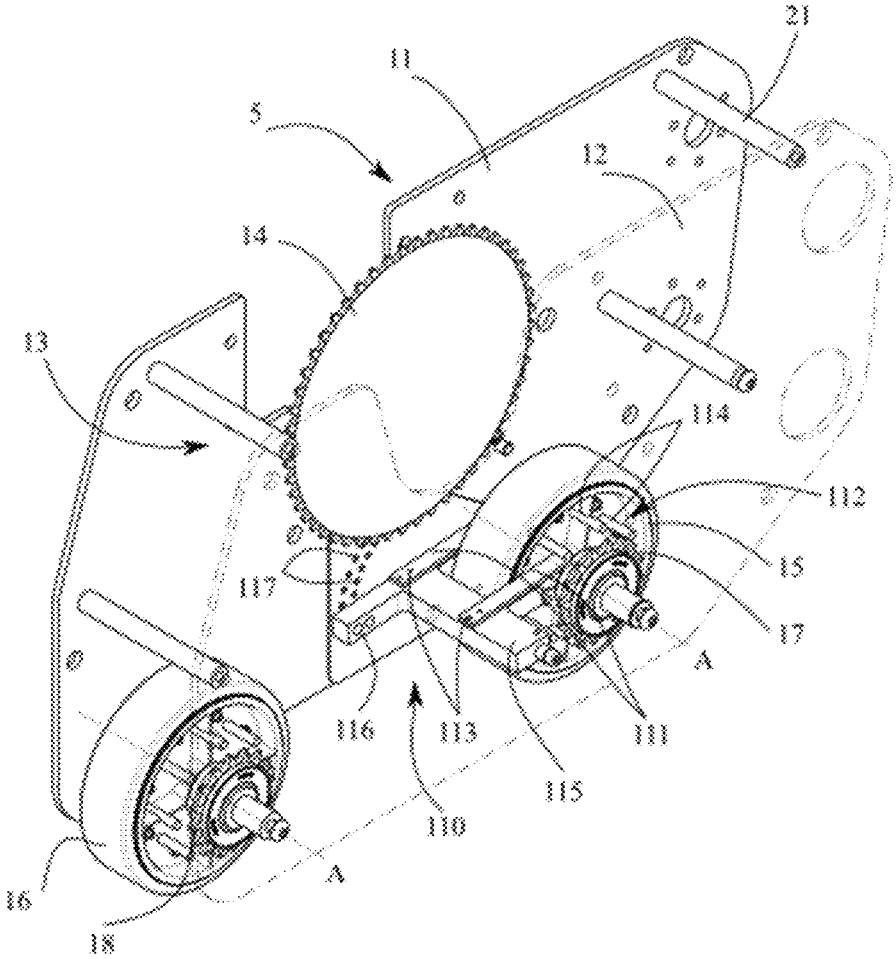
FIG. 7 is a perspective view of a carriage of a rolling-unrolling device according to a second alternative embodiment of the invention.
Figure 8:
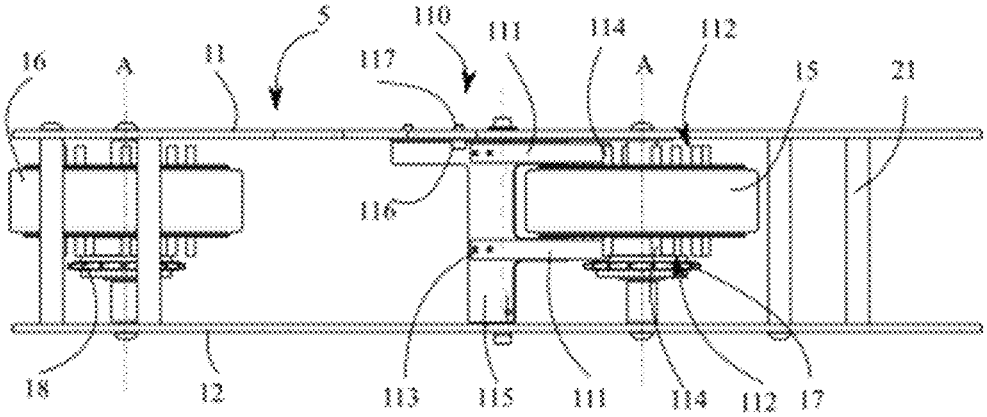
FIG. 8 is an overhead view of the carriage in FIG. 7 to show an adjustable braking system.
Figure 9:
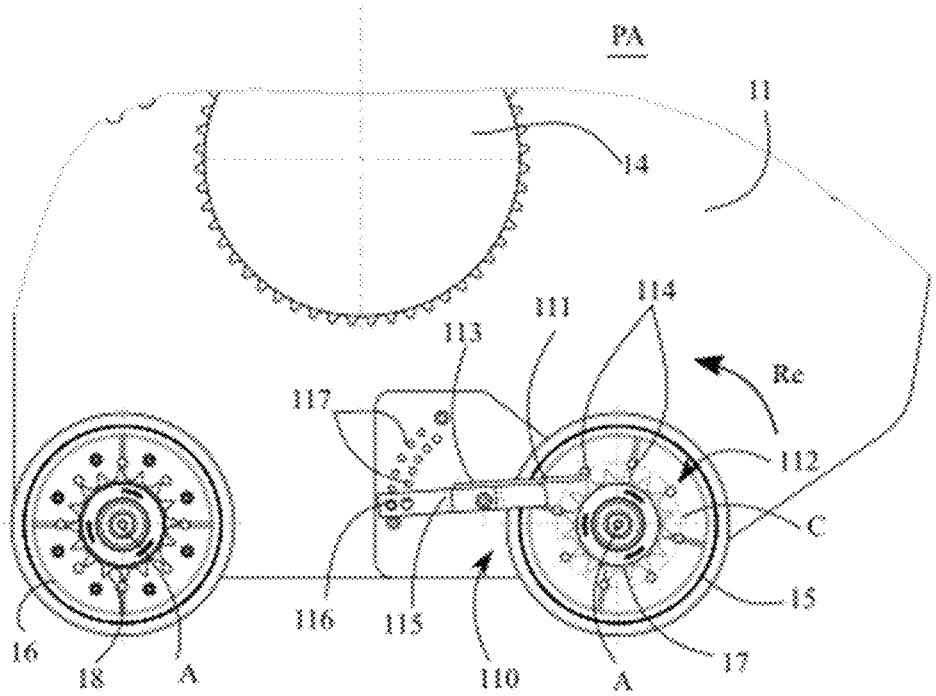
FIG. 9 is a plan view of one face of the carriage in FIG. 7, showing the braking system in a first braking position corresponding to the mode for rolling up the cover.
Figure 10:
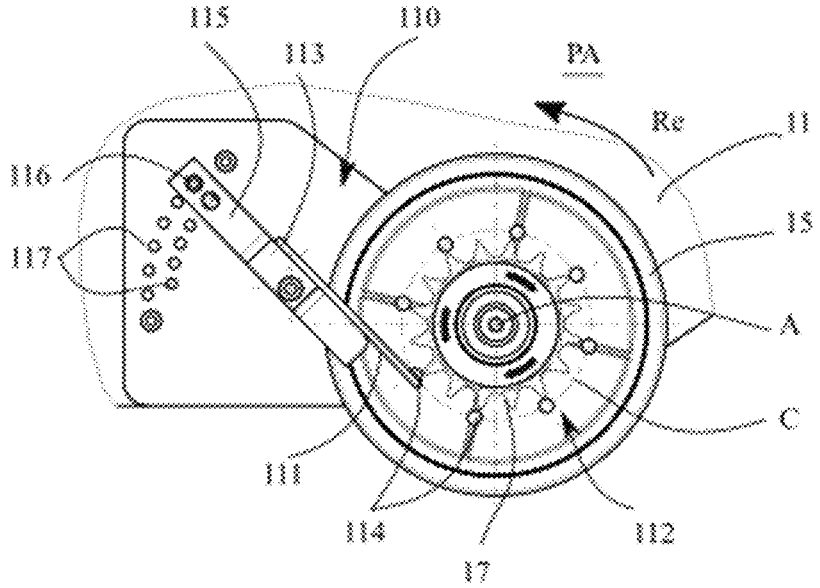
FIG. 10 is an enlarged view of the braking system in FIG. 9 in a second braking position which again corresponds to the mode for rolling up the cover.

FIGS. 2 to 6 show a simplified, non-limiting example of a carriage 5 of the device 1. The two carriages 5 and 6 may or may not be identical, may or may not be reversible and may or may not be interchangeable with one another. The carriage 5 comprises a covered chassis, only two side flanges 11, 12 whereof are shown. These flanges 11, 12 extend along substantially vertical planes and are held apart from one another by spacers 21 (FIGS. 7 and 8) so as to delimit an inner space 13 receiving the drive means and the rolling means. In the example shown, the drive means are shown by a drive gear 14 linked, on the one hand, to the roller tube 4 and on the other hand to a motor (not shown) or any other equivalent actuator, which can be electrical, pneumatic, hydraulic or magnetic. In the example shown, the rolling means comprise two wheels 15, 16, a front wheel 15 and a back wheel 16, preferably aligned along an axis X. In order to limit the inertial displacement and increase the stability of each carriage 5, 6, the plane passing through the wheels 15 and 16 can have a zero angle or a non-zero angle (toe-in or toe-out) with the XZ-plane, the rotational axes A of the wheels 15 and 16 remaining parallel to one another. The relative notions front AV and back AR are defined when the device 1 is displaced in the direction D corresponding to the unrolling of the cover 2. The two wheels 15 and 16 are drive wheels. For this purpose, the drive means further comprise two counter drive gears 17, 18, each linked to a wheel 15, 16 and a power transmission in the form of a toothed belt 19, chain, or similar element, which meshes with the drive gear 14 and the counter drive gears 17, 18 such that they all rotate in a same direction of rotation and at a constant speed of rotation. A tensioner 20 is provided on the path of the toothed belt 19 to guarantee the meshing thereof with the gears 14, 17, 18 and to automatically compensate for the operating clearance. The drive means are designed to rotate in both directions of rotation, i.e. in a direction of rotation represented by the arrows Rd corresponding to the direction D for unrolling the cover 2 and in the opposite direction of rotation represented by the arrows Re corresponding to the direction E for rolling up the cover 2. It goes without saying that the rolling means can differ from this example and comprise a single drive wheel, more than two wheels per carriage including one or more idler wheels, and the wheels are not necessarily aligned along an X-axis, but are offset, etc. Similarly, the drive means can differ from this example and comprise a tubular electric motor installed inside roller tube 4, but also a motor directly coupled to one of the gears 14. Preferentially, the drive means are common to the roller tube 4 and the one or more drive wheels 15, 16 of the two carriages 5, 6, and comprise a single motor for the entirety of the device 1. In any case, the drive means further comprise engaging/disengaging means for authorising a speed difference between the drive gear 14 and the counter drive gears 17, 18. These engaging/disengaging means are in particular formed by a free wheel (symbolised by three small arrows on the hub of each wheel 15, 16) arranged between each counter drive gear 17, 18 and the hub of the corresponding wheel 15, 16, and/or between the roller tube 4 and the drive gear 14, as described in the publication FR 2 893 651 A1.

The device 1 according to the invention constitutes an enhancement of the existing devices in that it comprises a braking system 100, 110 designed to slow or even to prevent the rotation of at least one of the wheels 15, 16 of one or preferably of the two carriages 5, 6, and cause an additional tensioning of the cover 2 during the rolling up thereof on said roller tube 4. The braking of the carriages 5, 6 has the technical effect of automatically recentring the cover 2 on the longitudinal displacement axis thereof perpendicularly to the roller tube 4, of synchronising the speed of displacement of the carriages 5, 6, and of positioning the crossbars 10 parallel to one another and to the roller tube 4. Thus, the cover 2 rolls up parallel to itself and in a uniform manner on the roller tube 4, the unbalance caused upon each passage of a crossbar 10 being automatically compensated by the braking of the carriages 5, 6 which move in a synchronous and homogeneous manner. Moreover, the one or more drive wheels 15, 16 of each carriage 5, 6 are designed to allow slippage between the hub of the wheel integral with a counter drive gear 17, 18 and the tread thereof in contact with the ground S, as described in particular in the publication FR 2 893 651 A1.

The braking system 100, 110 that will be described has the advantage of being suitable or adapted to any type of rolling-unrolling device compliant with the above description, such as the subject matters of the aforementioned publications FR 2 893 651 A1 and FR 2 908 402 A1, or that proposed in kit form in the patent application FR 3 084 095 A1 filed by the applicant.

The preferred braking system 100, 110 is a mechanical system that is simple in design, reliable, requires no maintenance, requires no play compensation and is inexpensive. It is designed to act on at least one of the wheels 15, 16 of the carriages 5, 6, outside of the tire and the tread thereof. Thus, the braking system is not sensitive to the state of the running surface on which the carriages 5, 6 travel, and thus to the climatic conditions (rain making the running surface slippery, temperature variations altering the tire hardness, etc.). Moreover, being physically independent of the tire, it does not cause any tire wear and requires no play compensation mechanism. This braking system 100, 110 is thus less sensitive to wear, and to the friction forces that occur on a pair of metal/plastic or plastic/plastic, and non-metal/rubber materials such as in the publication WO 2014/060708 A1.

This braking system 100, 110 is particularly designed to take at least two positions, i.e. a passive position PP in one direction of rotation Rd of the drive means corresponding to the unrolling of the cover 2, and an active position PA in the opposite direction of rotation Re of the drive means corresponding to the rolling up of the cover 2, the change from the passive position to the active position and vice-versa of the braking system 100, 110 being automatically generated by the reversal of the direction of rotation of the drive means, thus without any added mechanism. A plurality of alternative embodiments of the braking system 100, 110 can be considered. By way of non-limiting examples, FIGS. 2 to 6 show a so-called on/off braking system 100, and FIGS. 7 to 10 show a so-called adjustable braking system 110. An electromagnetic braking system (not described and not shown) that is active in the direction of rotation Re and passive (inactive) in the direction of rotation Rd, can also be suitable however involves a greater cost and complexity to implement than the solutions described below.

Figure 3:
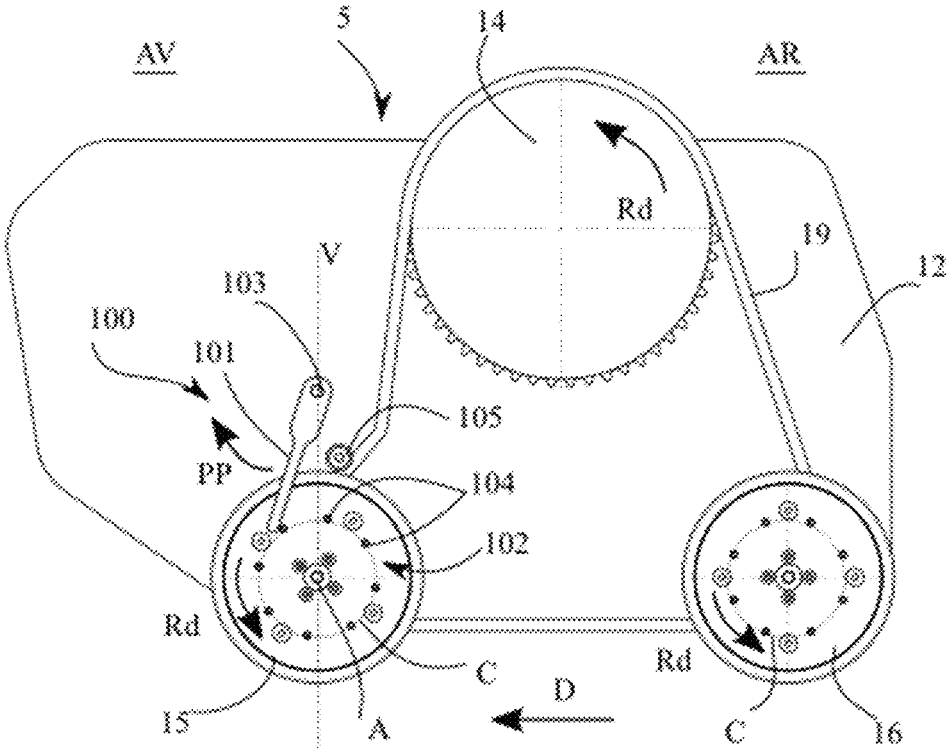
FIG. 3 is a plan view of the other face of the carriage in FIG. 2 to show a braking system in the inactive position corresponding to the mode for unrolling the cover.
Figure 4:
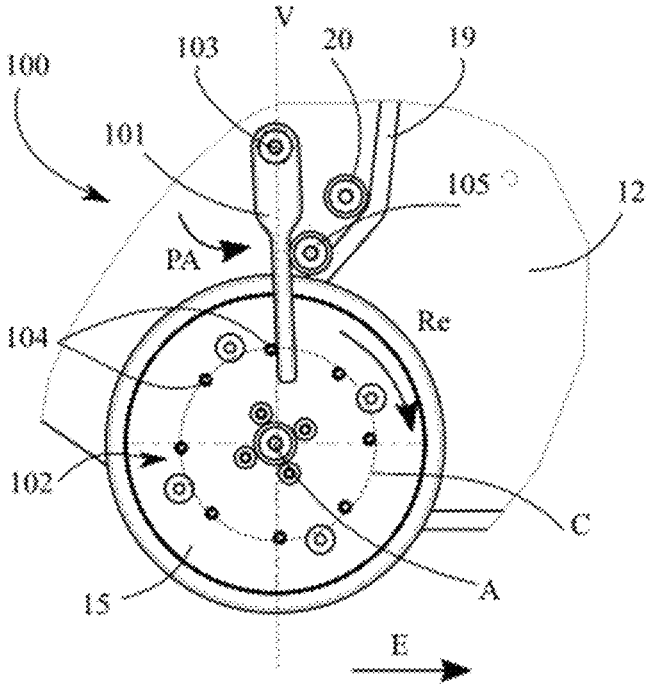
FIG. 4 is an enlarged view of the braking system in the active position corresponding to the mode for rolling up the cover.
Figure 5:
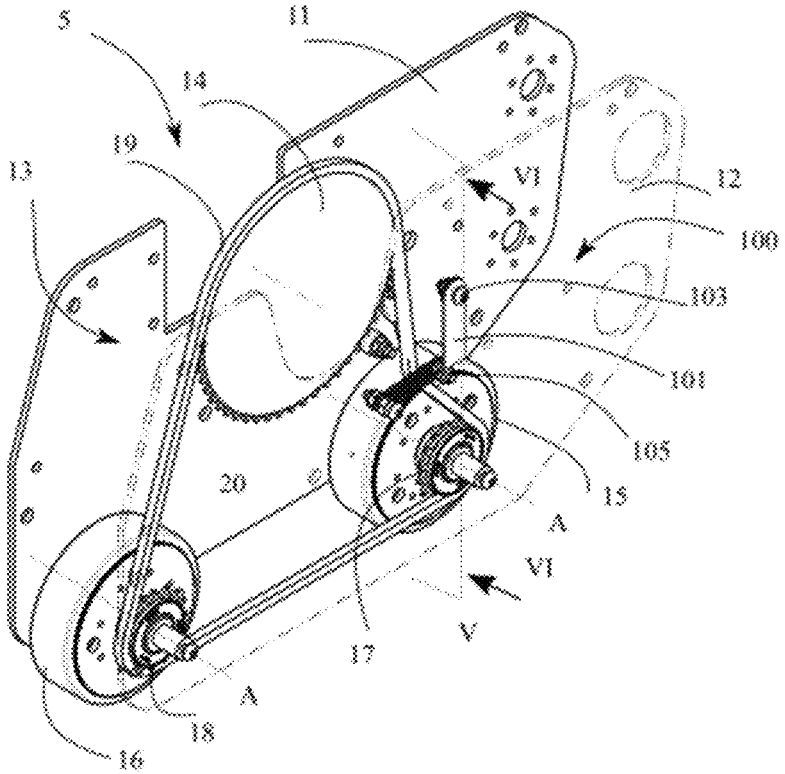
FIG. 5 is a perspective view of the carriage in FIGS. 2 and 3.

With reference to FIGS. 2 to 6, the braking system 100 is based on the principle of the pawl and ratchet wheel which only allows for a single direction of rotation. It is positioned on each of the carriages 5, 6 to synchronise the braking between the left carriage 5 and the right carriage 6, and acts on at least one of the drive wheels 15, 16. More specifically, it comprises a movable pawl 101 integral with the carriage 5, and a ratchet wheel 102 integral with the wheel 15, such that, in the direction of rotation Rd corresponding to the unrolling of the cover 2, the pawl 101 does not interact with the ratchet wheel 102 and the braking system 100 is in the passive position PP (FIG. 3), and in the opposite direction of rotation Re corresponding to the rolling up of the cover 2, the pawl 101 is engaged with the ratchet wheel 102 and the braking system 100 is in the active position PA (FIG. 4).

The pawl 101 comprises a rigid lever, mounted on one of the flanges 11 of the carriage 5, free to rotate about an articulation shaft 103 situated above and perpendicular to the wheel 15 of the carriage 5, so as to be able to pivot freely on either side of a vertical axis V passing through the articulation shaft 103 and the rotational axis A of the wheel 15. The rigid lever can be made of any non-deformable material that is resistant to bending, such as, for example, quenched steel, aluminium, a plastic material that may or may not be strengthened with composite fibres, or a similar material. The ratchet wheel 102 comprises a plurality of spurs 104, mounted on one of the flanks of the wheel 15 such that they project from one side of the wheel 15, and evenly distributed in a concentric circle C about the axis A. The spurs 104 form the stop notches of the ratchet wheel 102. They are also made of any non-deformable material that is resistant to bending, such as, for example, quenched steel, aluminium, a plastic material that may or may not be strengthened with composite fibres, or a similar material. In the stopped position of the device 1, the pawl 101 takes a neutral position wherein it extends, under gravity, radially inside the ratchet wheel 102 between two spurs 104 on the vertical axis V passing through the rotational axis A of the wheel 15. The braking system 100 further comprises a stop 105 fastened onto the flange 11 of the carriage 5 in the near vicinity of the pawl 101 in order to block it in the active position PA when engaged with the ratchet wheel 102. The stop 105 is arranged to the right of the vertical axis V passing through the articulation shaft 103 in order to block the pawl 101 only in the direction of rotation Re of the ratchet wheel 102. The length of the pawl 101 must be greater than the distance separating the articulation shaft 103 from the circle C of the ratchet wheel 102 on the vertical axis V, such that the free end of the pawl 101 can penetrate the inside of the ratchet wheel 102 between the spurs 104 and remain blocked therein when the pivoting of the pawl 101 is stopped by the stop 105 (FIG. 4). The length of the pawl 101 must also be less than the distance separating the articulation shaft 103 from the spur 104 situated on the tangent to the circle C that passes through the articulation shaft 103, opposite the stop 105, such that the free end of the pawl 101 can escape from the spurs 104 when the pivoting of the pawl 101 has not been stopped by the stop 105 (FIG. 3).

With reference to FIGS. 7 to 10, the braking system 110 is also based on the principle of the pawl and ratchet wheel, however the retaining force whereof is adjustable. The retaining force is different depending on the direction of rotation considered: it is stronger in the direction of rotation Re than in the direction of rotation Rd. It is positioned on each of the carriages 5, 6 to synchronise the braking between the left carriage 5 and the right carriage 6, and acts on at least one of the drive wheels 15, 16. More specifically, it comprises a movable pawl 111 integral with the carriage 5, and a ratchet wheel 112 integral with the wheel 15, such that, in the direction of rotation Rd corresponding to the unrolling of the cover 2, the pawl 111 is less strongly engaged with the ratchet wheel 112 and in the opposite direction of rotation Re corresponding to the rolling up of the cover 2, the pawl 111 is more strongly engaged with the ratchet wheel 112.

The pawl 111 comprises a flexible lever, and in the example shown, two parallel flexible levers, mounted on the carriage 5, at a fixed point 113 that is offset relative to the vertical axis V passing through the rotational axis A of the wheel 15 of the carriage 5 so as to extend more or less inside the ratchet wheel 112. The flexible lever can be made of any resilient material such as, for example, a spring steel strip, an elastomer strip, or a similar material. The ratchet wheel 112 comprises a plurality of spurs 114, mounted on the two flanks of the wheel 15 such that they project from the two sides of the wheel 15, and evenly distributed in two concentric circles C about the axis A, of the same diameter, in order to form two identical and parallel ratchet wheels 112. The spurs 114 form the stop notches of the ratchet wheel 112. They are made of any non-deformable material that is resistant to bending, such as, for example, quenched steel, aluminium, a plastic material that may or may not be strengthened with composite fibres, or a similar material. In the stopped position of the device 1, the pawl 111 takes a neutral position in which it extends along an axis more or less inclined relative to the horizontal in order to penetrate more or less inside the ratchet wheels 112 between two spurs 114. In the example shown, the pawl 111 is mounted on a support 115 that can be angularly adjusted relative to the circle C of the ratchet wheel 112, such that in the active position, the pawl 111 extends over a straight line that can be more or less tangent to said circle C (FIG. 10), procuring minimum braking, or which crosses said circle C without passing through the rotational axis A of the wheel 15 (FIG. 9), procuring maximum braking. The support 115 is fastened onto the flange 11 of the carriage 5, directly or by way of a plate, by a ball screw 116 through positioning holes 117, or any other equivalent blocking member. The holes 117 thus define a plurality of positions for adjusting the inclination of the pawl 111. In order to obtain a relatively precise adjustment pitch, the holes 117 are in a staggered arrangement over two concentric arcs of a circle. The ball screw 116 is actuated by hand and allows for the precise adjustment of the angular position of the pawl 111 when first commissioning the device 1 as a function of the real situation and tests conducted, in order to find the most satisfactory braking position.

Figure 6:
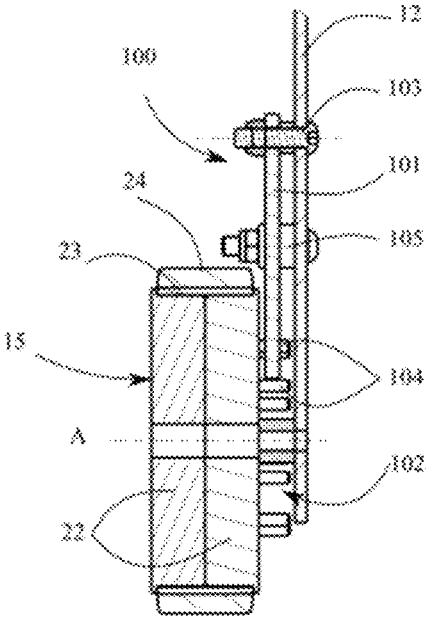
FIG. 6 is a sectional view perpendicular to the drive wheel of the carriage in FIG. 5.

FIG. 6 shows an example wheel 15, 16 of the carriages 5, 6 allowing a slippage effect when the braking system 100, 110 is in the active position. For these purposes, the one or more wheels 15, 16 comprises or comprise a core 22 supporting a rim 23 comprising a tire 24 in contact with the ground S or any other running surface. The core 22 can slip on the rim 23 under the action of a slippage force originating from the difference in rotational speed therebetween. The slippage allows the speed difference therebetween to be compensated and allows them to rotate at an adapted speed. Preferably, the core 22 is made of, or comprises, one or a mixture of plastic materials, preferably polymer materials, and is advantageously made of polyoxymethylene (POM). The rim 23 is made of, or comprises, one or a mixture of metals or metal alloys. Preferably, it is made of stainless steel. The rim 23 could also be made of one or a mixture of plastic materials. The tire 24 is made of, or comprises, one or a mixture of appropriate materials for obtaining high adherence of the wheel 15, 16 to the ground S, favouring slippage of the rim 23 on the core 22. The tire 24 is, for example, made of elastomer materials such as natural rubbers, synthetic rubbers, EPDM rubbers, polyurethanes, and similar materials. In particular, the material of the tires 24 is chosen from the family of EPDM-type rubbers having a low Shore hardness that lies, for example, in the range 40 to 70 ShA and a high ultimate tensile strength that lies, for example, in the range 30 to 50 MPa. These values are indicative and non-limiting.

However, the different example materials stipulated are not limiting and any other material having equivalent properties can be considered. In order to optimise the slippage, a coefficient of friction between the core 22 and the rim 23 is chosen such that it is less than the coefficient of friction between the tire 24 and the ground S. The difference between the coefficient of friction between the core 22 and the rim 23 and the coefficient of friction between the tire 24 and the ground S can, for example, lie in the range 0.05 to 0.5. In this embodiment, the ratchet wheel 102, 112 of the braking system 100, 110 is advantageously integral with the core 22 of the wheel 15, 16.

It goes without saying that the present invention is not limited to the example embodiments described herein, but encompasses all amendments and alternatives that are clear to a person skilled in the art within the scope of the accompanying claims.

The invention claimed is:

1. A Rolling-unrolling device for a protective cover for covering a surface to be protected, said device comprising a roller tube supported at the ends thereof by two carriages provided with wheels, at least one of said wheels is a drive wheel, and means for driving the rotation of said roller tube and of said at least one drive wheel designed to displace said device in translation relative to said surface to be protected in one direction in order to unroll said cover and in the opposite direction in order to roll up said cover, said device further comprising a braking system designed to slow or prevent the rotation of said at least one drive wheel of the carriages and cause said cover to be tensioned at least during the rolling up of said cover on said roller tube, characterized in that said at least one drive wheel comprises a core supporting a rim comprising a tire, in that said core is designed to slip on said rim under the action of a slippage force originating from their difference in rotational speed, and in that said braking system is designed to act on the core of said at least one drive wheel.

2. The device according to claim 1, characterized in that said braking system is a mechanical system designed to take at least two unstable positions; a passive position in one direction of rotation of said drive means corresponding to the unrolling of said cover, and an active position in the opposite direction of rotation of said drive means corresponding to the rolling up of said cover, the change from the passive position to the active position and vice-versa of said braking system being automatically generated by the reversal of the direction of rotation of said drive means.

3. The device according to claim 2, characterized in that said braking system comprises a movable pawl integral with each of said carriages, and a ratchet wheel integral with said at least one drive wheel of each of said carriages, such that, in the direction of rotation corresponding to the unrolling of said cover, the pawl is not engaged with the ratchet wheel and the braking system is in the passive position, and in the opposite direction of rotation corresponding to the rolling up of said cover, the pawl is engaged with the ratchet wheel and the braking system is in the active position.

4. The device according to claim 3, characterized in that said ratchet wheel is integral with the core of said at least one drive wheel.

5. The device according to claim 4, characterized in that said ratchet wheel comprises a plurality of projecting spurs on at least one of the sides of said at least one drive wheel and arranged in a circle concentric with the rotational axis of said drive wheel.

6. The device according to claim 3, characterized in that the pawl comprises a rigid lever, mounted on each of said carriages, free to rotate about an articulation shaft situated above and perpendicular to said at least one of the wheels of the carriage, such that in the neutral position, said pawl extends under gravity radially inside said corresponding ratchet wheel, along a vertical axis passing through the rotational axis of said wheel.

7. The device according to claim 6, characterized in that said braking system further comprises a stop fastened onto each of said carriages in the near vicinity of said pawl in order to block it in the active position when engaged with said ratchet wheel.

8. The device according to claim 3, characterized in that the pawl comprises a flexible lever, mounted on each of said carriages, at a fixed point that is offset relative to the vertical axis passing through the rotational axis of said at least one of the wheels of the carriage, such that, in the neutral position, said pawl extends more or less inside said corresponding ratchet wheel.

9. The device according to claim 8, characterized in that said braking system is adjustable and in that said pawl is mounted on a support that can be angularly adjusted relative to said ratchet wheel, such that said pawl is more or less inclined relative to the circle formed by said ratchet wheel so as to adjust the brake force.

10. The device according to claim 9, characterized in that the support of said pawl is mounted on the carriage by angular adjustment means.

11. The device according to claim 10, characterized in that the angular adjustment means comprise a ball screw housed through positioning holes defining a plurality of positions for adjusting the inclination of said pawl.

12. The device according to claim 1, characterized in that the plane passing through the wheels of a same carriage is parallel to the XZ-plane of an orthonormal frame of reference.

13. The device according to claim 1, characterized in that the plane passing through the wheels of a same carriage forms an angle of less than 10° with the XZ-plane of an orthonormal frame of reference, the rotational axes of said wheels remaining parallel.

14. The device according to claim 1, characterized in that the coefficient of friction between the core and the rim is less than the coefficient of friction between the tire and the ground, the difference between the two coefficients lying in the range 0.05 to 0.5.

15. The device according to claim 1, characterized in that the material of the tire is derived from the family of EPDM-type rubbers having a low Shore hardness that lies in the range 40 to 70 ShA.

16. The device according to claim 1, characterized in that the material of the tire is derived from the family of EPDM-type rubbers having a high ultimate tensile strength that lies in the range 30 to 50 MPa.

* * * * *